US009206379B2

(12) United States Patent
Smith

(10) Patent No.: US 9,206,379 B2
(45) Date of Patent: Dec. 8, 2015

(54) LUBRICATING COMPOSITION

(75) Inventor: Peter William Robert Smith, Hamburg (DE)

(73) Assignee: Shell Oil Company, Houston, TX (US)

( * ) Notice: Subject to any disclaimer, the term of this patent is extended or adjusted under 35 U.S.C. 154(b) by 199 days.

(21) Appl. No.: 13/634,594

(22) PCT Filed: Mar. 16, 2011

(86) PCT No.: PCT/EP2011/053942

§ 371 (c)(1),
(2), (4) Date: Sep. 13, 2012

(87) PCT Pub. No.: WO2011/113851

PCT Pub. Date: Sep. 22, 2011

(65) Prior Publication Data

US 2013/0012421 A1 Jan. 10, 2013

(30) Foreign Application Priority Data

Mar. 17, 2010 (EP) ..... 10156764

(51) Int. Cl.
*C10M 171/00* (2006.01)
*C10M 129/24* (2006.01)
*C10M 171/02* (2006.01)

(52) U.S. Cl.
CPC ..... *C10M 171/02* (2013.01); *C10M 171/00* (2013.01); *C10M 2203/1006* (2013.01); *C10M 2205/0285* (2013.01); *C10M 2205/173* (2013.01); *C10M 2207/026* (2013.01); *C10M 2207/401* (2013.01); *C10M 2215/064* (2013.01); *C10N 2220/022* (2013.01); *C10N 2230/02* (2013.01); *C10N 2230/08* (2013.01); *C10N 2240/201* (2013.01)

(58) Field of Classification Search
CPC ..... C10M 2207/08; C10M 2211/06
USPC ..... 508/578
See application file for complete search history.

(56) References Cited

U.S. PATENT DOCUMENTS

| | | | | |
|---|---|---|---|---|
| 4,824,601 | A | 4/1989 | Franklin | 252/401 |
| 2008/0242564 | A1 | 10/2008 | Chinn et al. | 508/110 |
| 2009/0137435 | A1 | 5/2009 | Hilker et al. | 508/279 |
| 2011/0294620 | A1 * | 12/2011 | Pruitt et al. | 477/5 |

FOREIGN PATENT DOCUMENTS

| | | | |
|---|---|---|---|
| EP | 0668342 | 8/1995 | C10G 65/04 |
| EP | 0776959 | 6/1997 | C10G 65/04 |
| WO | WO9721788 | 6/1977 | C10G 67/04 |
| WO | WO9920720 | 4/1999 | C10M 143/09 |
| WO | WO9941332 | 8/1999 | C10G 69/02 |
| WO | WO0008115 | 2/2000 | C10G 45/58 |
| WO | WO0014179 | 3/2000 | C10G 2/00 |
| WO | WO0014183 | 3/2000 | C10G 45/58 |
| WO | WO0014187 | 3/2000 | |
| WO | WO0014188 | 3/2000 | C10M 105/04 |
| WO | WO0015736 | 3/2000 | C10G 65/00 |
| WO | WO0118156 | 3/2001 | C10M 101/02 |
| WO | WO0187166 | 11/2001 | A61B 17/00 |
| WO | WO02070631 | 9/2002 | C10G 65/16 |
| WO | WO2009071608 | 6/2009 | |
| WO | WO2009115502 | 9/2009 | C10M 107/02 |

OTHER PUBLICATIONS

Takaaki, Kanoh et al.; "Analyses of Electro-chemical Characteristics of Palm Fatty Acid Esters as Insulating Oil"; IEEE International Conference On; ICDL 2008; pp. 1-4; Jun. 2008.
Kirk-Othmer Encyclopedia of Chemical Technology; "Lubrication and Lubricants"; 3rd Edition, vol. 14, pp. 477-526, (1979).
Kohtoh, M. et al.; Aging Effect on Electrical Characteristics of Insulating Oil in Field Transformer; IEEE Transactions on Dielectrics and Electrical Insulation; vol. 16., No. 6, pp. 1698-1706; Dec. 1, 2009.

* cited by examiner

*Primary Examiner* — Vishal Vasisth

(57) ABSTRACT

Use of a lubricating composition for cooling and/or electrically insulating an electric battery in a Kinetic Energy Recovery System or a hybrid vehicle wherein the lubricating composition comprises (i) a base oil selected from mineral oils, synthetic oils or vegetable oils and mixtures thereof, (ii) at least one anti-oxidant additive and (iii) less than 60 ppm of water, and wherein the lubricating composition has a specific heat capacity of at least 2.06 kJ/Kg/K and a kinematic viscosity at 40° C. of at most 20 $mm^2/s$.

15 Claims, No Drawings

LUBRICATING COMPOSITION

CROSS-REFERENCE TO RELATED APPLICATIONS

The present application claims priority from PCT/EP2011/053942, filed 16 Mar. 2011, which claims priority from European Patent Application No. EP 10156764.2, filed 17 Mar. 2010.

FIELD OF THE INVENTION

The present invention relates to the use of a lubricating composition for cooling and/or electrically insulating an electric battery or electric motor. In particular, the present invention relates to the use of a lubricating composition for cooling and/or insulating an electric battery present in a Kinetic Energy Recovery System (KERS) or a hybrid vehicle.

BACKGROUND OF THE INVENTION

The acronym "KERS" stands for Kinetic Energy Recovery System. The KERS device recovers the kinetic energy that is present in the waste heat created by a car's braking process. It stores that energy and converts it into electrical or mechanical power that can be called upon to boost acceleration.

There are two types of KERS system; battery (electrical) and flywheel (mechanical). Electrical systems use a motor-generator incorporated in the car's transmission which converts mechanical energy into electrical energy and vice versa. Once the energy has been harnessed, it is stored in a bank of lithium ion batteries and released when required.

The KERS system has been used in Formula One racing cars. The rules of Formula One allowed the KERS system to deliver a maximum of 60 kW extra power (approximately 80 bhp), while the storage capacity is limited to 400 kilojoules. The extra 60 kW of power (equivalent to ten percent of peak engine power) is available for anything up to 6.67 s per lap, and can be released at the press of a boost button either all in one go, or at different points around the racing track. Consequently, the KERS system can provide lap time improvements in the range of from about 0.1 seconds to 0.4 seconds.

Advantageously, the KERS system promotes the development of environmentally friendly and road car-relevant technologies in Formula One racing, and helps the driver with overtaking. A chasing driver can use his boost button to help him pass the car in front, while a leading driver can use his boost button to escape the car behind.

The quest for vehicle fuel efficiency in road cars has lead to the development of hybrid vehicles by a number of automobile companies. As used herein, the term "hybrid vehicle" refers to a vehicle having two means of propulsion, for example, (1) a combustion engine either gasoline or diesel fuelled and (2) an electric motor receiving power from on-board batteries which are charged by engine (1) or by regenerative braking. Using the KERs system in road cars would help to reduce their fuel consumption.

The typical method of cooling the electric battery in the KERS system is by air cooling. However, air cooling is not always sufficient, and liquids such as water are not considered suitable. It has now surprisingly been found by the present inventors that lubricating compositions comprising certain components and having certain physical properties provide excellent cooling and/or insulating benefits when used in the electric battery or electric motor of a KERS system. It has also been found that said lubricating compositions can provide excellent cooling and/or insulating benefits in the electric battery or electric motor of a hybrid vehicle.

SUMMARY OF THE INVENTION

According to the present invention there is provided the use of a lubricating composition for cooling and/or insulating an electric battery or electric motor in a Kinetic Energy Recovery System or a hybrid vehicle wherein the lubricating composition comprises (i) a base oil selected from mineral oils, synthetic oils, vegetable oils and mixtures thereof, (ii) at least one antioxidant and (iii) less than 60 ppm of water, and wherein the lubricating composition has a specific heat capacity (according to ASTM E 1269) of at least 2.06 kJ/Kg/K and a kinematic viscosity at 40° C. of at most 20 $mm^2/s$ According to the present invention there is further provided a lubricating composition for cooling and/or insulating an electric battery or electric motor in a Kinetic Energy Recovery System or a hybrid vehicle wherein the lubricating composition comprises (i) a base oil selected from mineral oils, synthetic oils, vegetable oils and mixtures thereof, (ii) at least one antioxidant and (iii) less than 60 ppm of water, and wherein the lubricating composition has a specific heat capacity (according to ASTM E 1269) of at least 2.06 kJ/Kg/K and a kinematic viscosity at 40° C. of at most 20 $mm^2/s$.

DETAILED DESCRIPTION OF THE INVENTION

The lubricating composition herein comprises a base oil, an antioxidant and less than 60 ppm of water.

There are no particular limitations regarding the base oil used in the lubricating composition, provided that the kinematic viscosity of the lubricating composition at 40° C. is at most 20 $mm^2/s$ and the specific heat capacity of the lubricating composition according to ASTM E 1269 at 40° C. is at least 2.06 kJ/Kg/K. Various conventional mineral oils, synthetic oils as well as naturally derived esters such as vegetable oils may be conveniently used.

The base oil may conveniently comprise mixtures of one or more mineral oils and/or one or more synthetic oils; thus, the term "base oil" may refer to a mixture containing more than one base oil. Mineral oils include liquid petroleum oils and solvent-treated or acid-treated mineral lubricating oil of the paraffinic, naphthenic, or mixed paraffinic/naphthenic type which may be further refined by hydrofinishing processes and/or dewaxing.

Suitable base oils for use in the lubricating oil composition are Group I-III mineral base oils, Group IV poly-alpha olefins (PAOs), Group V naphthenic mineral oils, Group II-III Fischer-Tropsch derived base oils and mixtures thereof.

By "Group I", "Group II", "Group III", "Group IV" and "Group V" base oils are meant lubricating oil base oils according to the definitions of American Petroleum Institute (API) for categories I-V. These API categories are defined in API Publication 1509, 16th Edition, Appendix E, April, 2007.

Fischer-Tropsch derived base oils are known in the art. By the term "Fischer-Tropsch derived" is meant that a base oil is, or is derived from, a synthesis product of a Fischer-Tropsch process. A Fischer-Tropsch derived base oil may also be referred to as a GTL (Gas-To-Liquids) base oil. Suitable Fischer-Tropsch derived base oils that may be conveniently used as the base oil in the lubricating composition are those as for example disclosed in EP 0 776 959, EP 0 668 342, WO 97/21788, WO 00/15736, WO 00/14188, WO 00/14187, WO 00/14183, WO 00/14179, WO 00/08115, WO 99/41332, EP 1 029 029, WO 01/18156 and WO 01/57166.

Synthetic oils include hydrocarbon oils such as olefin oligomers (including polyalphaolefin base oils; PAOs), dibasic acid esters, polyol esters, polyalkylene glycols (PAGs), alkyl naphthalenes and dewaxed waxy isomerates. Synthetic hydrocarbon base oils sold by the Shell Group under the designation "Shell XHVI" (trade mark) may be conveniently used.

Poly-alpha olefin base oils (PAOs) and their manufacture are well known in the art. Preferred poly-alpha olefin base oils that may be used in the lubricating compositions may be derived from linear $C_2$ to $C_{32}$, preferably $C_6$ to $C_{16}$, alpha olefins. Particularly preferred feedstocks for said poly-alpha olefins are 1-octene, 1-decene, 1-dodecene and 1-tetradecene.

A preferred base oil for use in the lubricating composition herein is a poly-alpha olefin base oil, for example, PAO-2.

Another preferred base oil for use in the lubricating composition herein is a Fischer-Tropsch derived base oil, for example GTL 3 (having a kinematic viscosity at 100° C. of approximately 3 $mm^2/s$), which may be prepared according to the method described in WO02/070631.

Another preferred base oil for use in the lubricating composition herein is a Group III mineral oil such as those commercially available from SK Energy, Ulsan, South Korea under the tradenames Yubase 3 and Yubase 4.

The total amount of base oil incorporated in the lubricating composition is preferably in the range of from 60 to 99 wt. %, more preferably in the range of from 65 to 98 wt. % and most preferably in the range of from 70 to 95 wt. %, with respect to the total weight of the lubricating composition.

The density of the base oil for use herein is preferably in the range of from 780 to 820 $kg/m^3$, more preferably in the range of from 790 to 810 $kgm^3$ at 15° C. by ASTM D 1298.

As mentioned above, the finished lubricating composition has a kinematic viscosity at 40° C. (as measured by ASTM D 445) of at most 20 $mm^2/s$, preferably at most 15 $mm^2/s$, even more preferably at most 12 $mm^2/s$ and especially at most 11 $mm^2/s$. Preferably, the finished lubricating composition has a kinematic viscosity at 40° C. of at least 3 $mm^2/s$, more preferably at least 4 $mm^2/s$, even more preferably at least 5 $mm^2/s$.

As mentioned above, the finished lubricating composition has a specific heat capacity at 40° C. (according to ASTM E 1269) of at least 2.06 kJ/Kg/K, preferably at least 2.08 kJ/Kg/K, more preferably at least 2.10 kJ/Kg/K. Preferably, the finished lubricating composition has a specific heat capacity at 40° C. of at most 3.5 kJ/Kg/K, more preferably at most 3 kJ/Kg/K, even more preferably at most 2.5 kJ/Kg/K.

It is preferred that the finished lubricating composition has a flashpoint (according to ASTM D 93) of at least 135° C., more preferably at least 150° C.

The lubricating compositions herein preferably have a breakdown voltage of at least 1 kV, more preferably at least 30 kV as measured by IEC 60156.

The lubricating compositions herein preferably have a thermal conductivity of at least 0.130 W/m/K, more preferably at least 0.134 W/m/K, at 20 C as measured by a calibrated thermal properties meter.

The lubricating compositions herein preferably have a Viscosity Index of greater than 120.

The lubricating compositions herein comprise no more than 60 ppm of water, preferably no more than 50 ppm, even more preferably no more than 30 ppm.

A further essential component in the lubricating composition herein is an antioxidant. Said antioxidants may be generally present in a total amount in the range of from 0.08 to 3 wt. %, preferably in the range of from 0.08 to 1 wt %, more preferably in the range of from 0.08 to 0.4 wt %, based on the total weight of said lubricating composition.

Antioxidants that may be conveniently used are so-called hindered phenolic or amine antioxidants, for example naphthols, sterically hindered monohydric, dihydric and trihydric phenols, sterically hindered dinuclear, trinuclear and polynuclear phenols, alkylated or styrenated diphenylamines or ionol derived hindered phenols.

Sterically hindered phenolic antioxidants of particular interest may be selected from the group consisting of 2,6-di-tert-butylphenol (available under the trade designation "IRGANOX™ L 140" from CIBA), di tert-butylated hydroxytoluene ("BHT"), methylene-4,4'-bis-(2,6-tert-butylphenol), 2,2'-methylene bis-(4,6-di-tert-butylphenol), 1,6-hexamethylene-bis-(3,5-di-tert-butyl-hydroxyhydrocinnamate) (available under the trade designation "IRGANOX™ L109" from CIBA), ((3,5-bis(1,1-dimethylethyl)-4-hydroxyphenyl)methyl)thio) acetic acid, $C_{10}$-$C_{14}$isoalkyl esters (available under the trade designation "IRGANOX™ L118" from CIBA), 3,5-di-tert-butyl-4-hydroxyhydrocinnamic acid, $C_7$-$C_9$alkyl esters (available under the trade designation "IRGANOX™ L135" from CIBA) tetrakis-(3-(3,5-di-tert-butyl-4-hydroxyphenyl)-propionyloxymethyl)methane (available under the trade designation "IRGANOX™ 1010" from CIBA), thiodiethylene bis(3,5-di-tert-butyl-4-hydroxyhydrocinnamate (available under the trade designation "IRGANOX™ 1035" from CIBA), octadecyl 3,5-di-tert-butyl-4-hydroxyhydrocinnamate (available under the trade designation "IRGANOX™ 1076" from CIBA) and 2,5-di-tert-butylhydroquinone.

A particularly preferred antioxidant for use herein is di-tert-butylated hydroxytoluene ("BHT").

Examples of amine antioxidants that may be conveniently used include aromatic amine antioxidants for example N,N'-Di-isopropyl-p-phenylenediamine, N,N'-di-sec-butyl-p-phenylenediamine, N,N'-bis(1,4-dimethyl-pentyl)-p-phenylenediamine, N,N'-bis(1-ethyl-3-methyl-pentyl)-p-phenylenediamine, N,N'-bis(1-methyl-heptyl)-p-phenylenediamine, N,N'-dicyclohexyl-p-phenylene-diamine, N,N'-diphenyl-p-phenylenediamine, N,N'-di(naphthyl-2-)-p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, N'-cyclohexyl-N'-phenyl-p-phenylenediamine, 4-(p-toluene-sulfoamido)diphenylamine, N,N'-dimethyl-N,N'-di-sec-butyl-p-phenylenediamine, diphenylamine, N-allyldiphenylamine, 4-isopropoxy-diphenylamine, N-phenyl-1-naphthylamine, N-phenyl-2-naphthylamine, octylated diphenylamine, e.g. p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, di(4-methoxyphenyl)amine, 2,6-di-tert-butyl-4-dimethyl-aminomethylphenol, 2,4'-diaminodiphenylmethane, 4,4'-diaminodiphenylmethane, N,N,N',N'-tetramethyl-4,4'-diaminodiphenylmethane, 1,2-di(phenylamino)ethane, 1,2-di[(2-methylphenyl)amino]ethane, 1,3-di-(phenylamino)propane, (o-tolyl)biguanide, di[4-(1',3'-dimethylbutyl)phenyl]amine, tert-octylated N-phenyl-1-naphthylamine, mixture of mono- and dialkylated tert-butyl-/tert-octyldiphenylamines, 2,3-dihydro-3,3-dimethyl-4H-1,4-benzothiazine, phenothiazine, N-, tert-octylated phenothiazine, 3,7-di-tert-octylphenothiazine. In addition, amine antioxidants according to formula VIII and IX of EP-A-1054052, which compounds are also described in U.S. Pat. No. 4,824,601 may also be conveniently used.

The lubricating composition may further comprise additional additives) such as anti-wear additives, pour point depressants, corrosion inhibitors, copper passivators, defoaming agents and seal fix or seal compatibility agents.

The person skilled in the art is familiar with additives suitable for lubricating compositions. Specific examples of such additives are described in for example Kirk-Othmer Encyclopedia of Chemical Technology, third edition, volume 14, pages 477-526.

For example, the lubricating composition of the present invention may comprise one or more metal passivators, in particular one or more copper passivators.

Metal passivators or electrostatic discharge depressants, sometimes also referred as metal deactivators, that may be conveniently used include N-salicylideneethylamine, N,N'-di salicylideneethyldiamine, triethylenediamine, ethylenediamminetetraacetic acid, phosphoric acid, citric acid and gluconic acid. More preferred compounds are lecithin, thiadiazole, imidazole and pyrazole and derivatives thereof. Even more preferred compounds are benzotriazoles and their derivatives.

Most preferred are the compounds according to formula (I) or even more preferred the optionally substituted benzotriazole compound represented by the formula (II)

(I)

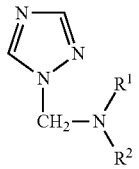

(II)

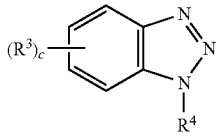

wherein $R^4$ may be hydrogen or a group represented by the formula (III)

(III)

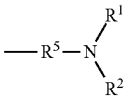

or by the formula (IV)

(IV)

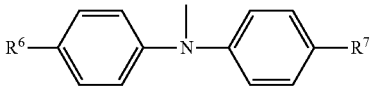

wherein:

c is 0, 1, 2 or 3;

$R^1$ and $R^2$ are hydrogen or the same or different straight or branched alkyl groups of 1-18 carbon atoms, preferably a branched alkyl group of 1-12 carbon atoms; $R^3$ is a straight or branched $C_{1-4}$ alkyl group, preferably $R^3$ is methyl or ethyl and C is 1 or 2; $R^5$ is a methylene or ethylene group; $R^6$ and $R^7$ are the same or different alkyl groups of 3-15 carbon atoms, preferably of 4-9 carbon atoms.

Preferred compounds are 1-[bis(2-ethylhexyl)-aminomethyl]benzotriazole, methylbenzotriazole, dimethylbenzotriazole, ethylbenzotriazole, ethylmethylbenzotriazole, diethylbenzotriazole and mixtures thereof. Other preferred compounds include (N-Bis(2-ethylhexyl)-aminomethyl-tolutriazole, non-substituted benzotriazole, and 5-methyl-1H-benzotriazole. Examples of copper passivator additives as described above are described in U.S. Pat. No. 5,912,212, EP-A-1054052 and in US-A-2002/0109127.

Metal passivator additives such as those described above are commercially available under the trade designations "BTA", "TTA", "IRGAMET 39", "IRGAMET 30" and "IRGAMET 38S" from CIBA Ltd Basel Switzerland, also traded under the trade name "Reomet" by CIBA.

The content of the above metal passivator in the lubricating composition herein is preferably above 1 mg/kg and more preferably above 5 mg/kg. A practical upper limit may vary depending on the specific application of the lubricating composition. This concentration may be up to 3 wt. %, preferably however in the range of from 0.001 to 1 wt. %. However, such compounds may be advantageously used at concentrations below 1000 mg/kg and more preferably below 300 mg/kg.

Preferred pour point depressants are hydrocarbon or oxygenated hydrocarbon type pour point depressants.

Although it is possible to include additional additives in the lubricating compositions herein, it is highly preferred to include no more than 2 wt % of additives in addition to the antioxidant described above. In a particularly preferred embodiment herein, the lubricating composition does not contain any additional additives over and above the essential antioxidant described hereinabove.

The lubricating compositions may be conveniently prepared by admixing the additives, for example as herein before described, with mineral and/or synthetic base oil.

The lubricating composition described herein is suitable for cooling and/or insulating electric batteries and/or electric motors for Kinetic Energy Recovery Systems as well as for cooling and/or insulating electric batteries and/or electric motors for hybrid vehicles.

The present invention will now be described by reference to the following Examples which are not intended to limit the scope of the invention in any way.

EXAMPLES

Example 1

A lubricating composition was prepared containing 99.7% by weight of PAO-2 and 0.3% of BHT antioxidant.

Comparative Examples 1 and 2

Comparative Example 1 was a commercially available electrical insulating oil from Shell Lubricants consisting of a naphthenic base oil with 0.3% BHT.

Comparative Example 2 was Thermia™ B, a commercially available heat transfer oil from Shell Lubricants.

Measurement of Physical Properties.

The viscosity and specific heat capacity of Example 1 and Comparative Examples 1 and 2 were measured at various temperatures using test methods ISO 3104 and ASTM E 1269 respectively. The results of these measurements are set out in Tables 1 and 2 below. The density and thermal conductivity of Example 1 and Comparative Examples 1 and 2 were also measured at various temperatures using test method ASTM D 1298 for density measurements and a calibrated thermal properties meter for thermal conductivity measurements. The results of these measurements are set out in Tables 3 and 4 below.

TABLE 1

| | Specific Heat Capacity kJ/Kg/K | | |
|---|---|---|---|
| Temperature, ° C. | Example 1 | Comparative Example 1 | Comparative Example 2 |
| 20 | 2.07 | 1.853 | 1.882 |
| 40 | 2.13 | 1.925 | 1.954 |
| 100 | 2.34 | 2.14 | 2.173 |

TABLE 2

| | Viscosity $mm^2/s$ | | |
|---|---|---|---|
| Temperature, ° C. | Example 1 | Comparative Example 1 | Comparative Example 2 |
| 40 | 5.07 | 9.50 | 25.05 |
| 100 | 1.70 | 2.21 | 4.70 |

TABLE 3

| | Density $kg/m^3$ | | |
|---|---|---|---|
| Temperature, ° C. | Example 1 | Comparative Example 1 | Comparative Example 2 |
| 20 | 0.7981 | 0.8778 | 0.8648 |

TABLE 4

| | Thermal Conductivity W/m/K | | |
|---|---|---|---|
| Temperature, ° C. | Example 1 | Comparative Example 1 | Comparative Example 2 |
| 20 | 0.136 | 0.13 | 0.134 |
| 40 | 0.134 | 0.129 | 0.133 |
| 100 | 0.132 | 0.125 | 0.128 |

As can be seen from the results in Tables 1 to 4 the lubricating composition of Example 1 (according to the present invention) has a higher specific heat capacity (at 20-100° C.) than Comparative Examples 1 and 2 (not according to the present invention). In addition, the viscosity of Example 1 is lower than that of Comparative Examples 1 and 2. The lower viscosity means that Example 1 exhibits more turbulent flow and therefore higher heat transfer than Comparative Examples 1 and 2. Further, the thermal conductivity of Example 1 is better than that of Comparative Examples 1 and 2. The combination of lower viscosity and better thermal conductivity means that Example 1 provides better cooling properties than Comparative Examples 1 and 2.

The lubricating composition of Example 1 was found to exhibit electrical insulating and cooling properties when used as a lubricating composition in the battery of a KERS system.

What is claimed is:

1. A method comprising cooling and/or electrically insulating an electric battery or electric motor in a Kinetic Energy Recovery System or a hybrid vehicle using a lubricating composition, wherein the lubricating composition comprises:

(i) a base oil selected from Fischer-Tropsch derived base oils having a kinematic viscosity at 100° C. of at most 4 $mm^2/s$, (ii) at least one anti-oxidant additive and (iii) less than 60 ppm of water, and wherein the lubricating composition has a specific heat capacity at 40° C. according to ASTM E 1269 of at least 2.06 kJ/Kg/K and a kinematic viscosity at 40° C. of at most 20 $mm^2/s$.

2. A method according to claim 1 wherein the lubricating composition has a specific heat capacity of at least 2.08 kJ/Kg/K.

3. A method according to claim 1 wherein the lubricating composition has a kinematic viscosity at 40° C. of at most 12 $mm^2/s$.

4. A method according to claim 1 wherein the lubricating composition has a breakdown voltage of at least 1 kV as measured by IEC 60156.

5. A method according to claim 1 wherein the lubricating composition has a flashpoint according to ASTM D 93 of at least 135° C.

6. A method according to claim 1 wherein the lubricating composition has a Viscosity Index of greater than 120.

7. A method according to claim 1 wherein the base oil is a poly-alpha olefin base oil derived from linear $C_6$ to $C_{16}$ alpha olefins.

8. A method according to claim 1 wherein the base oil is a Fischer-Tropsch derived base oil having a kinematic viscosity at 40° C. of from 5 $mm^2/s$ to 11 $mm^2/S$.

9. A method according to claim 1 wherein the antioxidant additive is selected from the group consisting of aminic antioxidants, phenolic antioxidants, and mixtures thereof.

10. A method according to claim 1 wherein the base oil is present in an amount in the range of from 98 to 99.02 wt %, based on the total weight of the lubricating composition.

11. A method according to claim 1 wherein the antioxidant is present in an amount in the range of from 0.08 to 3 wt %, based on the total weight of the lubricating composition.

12. A method according to claim 1 wherein the antioxidant is present in an amount in the range of from 0.08 to 1 wt %, based on the total weight of the lubricating composition.

13. A method according to claim 1 wherein the lubricating composition has a specific heat capacity of from 2.08 kJ/Kg/K to 2.5 kJ/Kg/K.

14. A method according to claim 1 wherein the lubricating composition has a kinematic viscosity at 40° C. of from 4 $mm^2/s$ to 12 $mm^2/s$.

15. A method according to claim 1 wherein the cooling and/or electrically insulating is in a Kinetic Energy Recovery System.

* * * * *